US008502094B2

(12) United States Patent
Chen

(10) Patent No.: US 8,502,094 B2
(45) Date of Patent: Aug. 6, 2013

(54) ILLUMINATED KEYBOARD

(75) Inventor: Bo-An Chen, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 364 days.

(21) Appl. No.: 12/940,642

(22) Filed: Nov. 5, 2010

(65) Prior Publication Data

US 2012/0080300 A1 Apr. 5, 2012

(30) Foreign Application Priority Data

Oct. 1, 2010 (TW) ..... 99133475 A

(51) Int. Cl.
*H01H 9/26* (2006.01)

(52) U.S. Cl.
USPC ..... 200/5 A

(58) Field of Classification Search
USPC ..... 200/5 A, 310, 314
See application file for complete search history.

(56) References Cited

U.S. PATENT DOCUMENTS

| | | | | |
|---|---|---|---|---|
| 6,369,800 | B1 * | 4/2002 | Nading et al. | 345/168 |
| 6,686,549 | B2 * | 2/2004 | Douzono et al. | 200/341 |
| 7,057,125 | B1 * | 6/2006 | Tsai | 200/310 |
| 2008/0205032 | A1 * | 8/2008 | Liu | 362/24 |
| 2012/0048702 | A1 * | 3/2012 | Liu | 200/5 A |
| 2012/0080299 | A1 * | 4/2012 | Chen | 200/5 A |

* cited by examiner

*Primary Examiner* — Vanessa Girardi
(74) *Attorney, Agent, or Firm* — Kirton McConkie; Evan R. Witt

(57) ABSTRACT

An illuminated keyboard includes a transparent frame plate, a key, a light source and a membrane switch circuit module. The light beam emitted by the light source is transmissible through the transparent frame plate. Consequently, the light source may be disposed on the membrane switch circuit module, between the key and the transparent frame plate, or under the transparent frame plate.

18 Claims, 13 Drawing Sheets

ILLUMINATED KEYBOARD

FIELD OF THE INVENTION

The present invention relates to a keyboard, and more particularly to an illuminated keyboard with a luminous function.

BACKGROUND OF THE INVENTION

Generally, the common input device of a computer system includes for example a mouse, a keyboard device or a trackball. Via the keyboard device, the user may input characters and instructions into the computer system. As a consequence, most users and most manufacturers pay much attention to the development of keyboard devices.

Hereinafter, the configurations and functions of a conventional keyboard device will be illustrated with reference to FIG. 1. FIG. 1 is a schematic view illustrating the outward appearance of a conventional keyboard device. The surface of the conventional keyboard device 1 includes plural keys. These keys include ordinary keys 10, numeric keys 11 and function keys 12. When one or more keys are pressed by the user, a corresponding signal is issued to the computer, and thus the computer executes a function corresponding to the pressed key or keys. For example, when the ordinary keys 10 are pressed, corresponding English letters or symbols are inputted into the computer system. In addition, the function keys 12 (F1~F12) can be programmed to cause corresponding application programs to provide certain functions.

With the maturity of computing technologies, the conventional keyboard 1 that has basic functions fails to meet the users' requirements. For this reason, the keyboard manufacturers make efforts in designing novel keyboards with diversified functions. Recently, an illuminated keyboard with a luminous function has been disclosed. FIG. 2 is a schematic side view illustrating a conventional illuminated keyboard. As shown in FIG. 2, the illuminated keyboard 2 comprises a key 20, a metallic base plate 21, a membrane switch circuit module 22, a light source 23 and a light guide plate 24. The key 20 comprises a keycap 201, a scissors-type connecting member 202 and an elastic element 203. From top to bottom, the keycap 201, the scissors-type connecting member 202, the elastic element 203, the membrane switch circuit module 22, the metallic base plate 21 and the light guide plate 24 of the illuminated keyboard 2 are sequentially shown. The light source 23 is arranged beside the light guide plate 24. Via a flexible printed circuit (FPC), the light source 23 is connected with a circuit board (not shown) of the illuminated keyboard 2. In addition, electricity is transmitted to the light source 23 through the flexible printed circuit 25. The light source 23 is used for emitting a light beam B. An example of the light source 23 is a light emitting diode (LED). In addition, the elastic element 203 is a transparent rubbery element.

In FIG. 2, the light guide plate 24 is used to guide the light beam B, and thus the light beam B can be diffused to the whole keyboard. In addition, the light guide plate 24 is used to change the propagating direction of the light beam B, so that the light beam B is moved upwardly. The membrane switch circuit module 22 is disposed on the metallic base plate 21. Moreover, the metallic base plate 21 has a first fixing structure 211, a second fixing structure 212 and two partition plate openings 213. Via the partition plate openings 213, the light beam B will be incident into the membrane switch circuit module 22. The keycap 201 comprises a first keycap fixing structure 2011, a second keycap fixing structure 2012 and a light-transmissible region 2013. The scissors-type connecting member 202 comprises a first frame 2021 and a second frame 2022. A first end 2021A of the first frame 2021 is connected with the second fixing structure 212. A second end 2021B of the first frame 2021 is connected with the first keycap fixing structure 2011. A first end 2022A of the second frame 2022 is connected with the first fixing structure 211. A second end 2022B of the second frame 2022 is connected with the second keycap fixing structure 2012.

Please refer to FIG. 2 again. When the key 20 is pressed and moved downwardly with respect to the metallic base plate 21, the first frame 2021 and the second frame 2022 of the scissors-type connecting member 202 are switched from an open-scissors state to a stacked state. In addition, as the keycap 201 is moved downwardly to press the elastic element 203, the elastic element 203 is sustained against the membrane switch circuit module 22, and thus a key signal corresponding to the pressed key 20 is generated. Whereas, when the pressing force exerted on the key 20 is eliminated, an elastic force provided by the elastic element 203 is acted on the keycap 201. Due to the elastic force, the keycap 201 is moved upwardly with respect to the metallic base plate 21, and the first frame 2021 and the second frame 2022 of the scissors-type connecting member 202 are switched from the stacked state to the open-scissors state. Consequently, the keycap 201 is returned to its original position. After the light beam B is emitted by the light source 23, the light beam B is directed to the light guide plate 24. By the light guide plate 24, the propagating direction of the light beam B is changed. Consequently, a portion of the light beam B is sheltered by the metallic base plate 21, but the other portion of the light beam B is guided toward the membrane switch circuit module 22 through the partition plate openings 213. Then, the light beam B successively passes through the membrane switch circuit module 22, the elastic element 203 and the light-transmissible region 2013 of the keycap 201, thereby illuminating the key 20.

The conventional illuminated keyboard, however, still has some drawbacks. For example, since the majority of the light beam B emitted by the light source 23, which is disposed under the metallic base plate 21, is sheltered by the metallic base plate 21, the conventional illuminated keyboard fails to be uniformly illuminated.

SUMMARY OF THE INVENTION

The present invention relates to an illuminated keyboard to be illuminated in a more uniform fashion.

In accordance with an aspect of the present invention, there is provided an illuminated keyboard. The illuminated keyboard includes a transparent frame plate, a membrane switch circuit module, at least one key and a light source. The membrane switch circuit module is disposed on the transparent frame plate. The key is connected with the transparent frame plate. When the key is pressed, the key is sustained against the membrane switch circuit module. The light source is arranged between the key and the transparent frame plate for emitting a light beam.

In an embodiment, the membrane switch circuit module includes an upper wiring board, a partition plate and a lower wiring board. The upper wiring board has at least one upper contact and a light source circuit pattern. The light source and the light source circuit pattern are disposed on the upper wiring board. The light source circuit pattern is connected with the light source for driving the light source. The partition plate is disposed under the upper wiring board, and has a first partition plate opening and a second partition plate opening. When the membrane switch circuit module is pressed, the upper contact is inserted into the first partition plate opening The light source is penetrated through the second partition plate opening The lower wiring board is disposed under the partition plate, and has a lower contact corresponding to the upper contact and a lower wiring board opening to be penetrated by the light source. When the membrane switch circuit module is pressed, the upper contact is contacted with the lower contact. The light source is successively penetrated through the second partition plate opening and the lower wiring board opening, and inserted into a frame plate opening of the transparent frame plate.

In an embodiment, the membrane switch circuit module includes an upper wiring board, a partition plate and a lower wiring board. The upper wiring board has at least one upper contact. The partition plate is disposed under the upper wiring board, and has a partition plate opening and a light source circuit pattern. When the membrane switch circuit module is pressed, the upper contact is inserted into the partition plate opening The light source and the light source circuit pattern are disposed on the partition plate. The light source circuit pattern is connected with the light source for driving the light source. The lower wiring board is disposed under the partition plate, and has a lower contact corresponding to the upper contact and a lower wiring board opening to be penetrated by the light source. When the membrane switch circuit module is pressed, the upper contact is contacted with the lower contact. The light source is penetrated through the partition plate opening, and inserted into a frame plate opening of the transparent frame plate.

In an embodiment, the membrane switch circuit module includes an upper wiring board, a partition plate and a lower wiring board. The upper wiring board has at least one upper contact. The partition plate is disposed under the upper wiring board, and has a partition plate opening When the membrane switch circuit module is pressed, the upper contact is inserted into the partition plate opening The lower wiring board is disposed under the partition plate, and has a lower contact corresponding to the upper contact and a light source circuit pattern. When the membrane switch circuit module is pressed, the upper contact is contacted with the lower contact. The light source and the light source circuit pattern are disposed on the lower wiring board. The light source circuit pattern is connected with the light source for driving the light source. The light source is inserted into a frame plate opening of the transparent frame plate.

In an embodiment, the illuminated keyboard further includes a supporting plate, which is disposed under the transparent frame plate for reflecting the light beam and avoiding bending the transparent frame plate.

In an embodiment, the illuminated keyboard further includes a light-guiding film layer, which is arranged between the supporting plate and the transparent frame plate for guiding the light beam. The light-guiding film layer has a light-guiding film opening to be penetrated by the light source. The light beam successively passes through the transparent frame plate, the light-guiding film layer, the supporting plate, the light-guiding film layer, the transparent frame plate, the membrane switch circuit module and the key.

In an embodiment, the key includes a keycap, a scissors-type connecting member and an elastic element. The keycap is exposed to a surface of the illuminated keyboard, and includes a light-transmissible region. The scissors-type connecting member is arranged between the transparent frame plate and the keycap for connecting the transparent frame plate and the keycap, and allowing the keycap to be moved upwardly and downwardly with respect to the transparent frame plate. The elastic element is arranged between the membrane switch circuit module and the keycap. When the keycap is pressed, the elastic element is compressed and sustained against the membrane switch circuit module, so that the upper contact is contacted with the lower contact. When a pressing force exerted on the key is eliminated, an elastic force provided by the elastic element is acted on the keycap, so that the keycap is returned to an original position.

In an embodiment, the keycap includes a first keycap fixing structure and a second keycap fixing structure. The transparent frame plate includes a first frame plate fixing structure and a second frame plate fixing structure. The first frame plate fixing structure and the second frame plate fixing structure are integrally formed with the transparent frame plate. The scissors-type connecting member includes a first frame and a second frame. A first end of the first frame is connected with the second frame plate fixing structure, a second end of the first frame is connected with the first keycap fixing structure, a first end of the second frame is connected with the second keycap fixing structure, and a second end of the second frame is connected with the first frame plate fixing structure.

In accordance with another aspect of the present invention, there is provided an illuminated keyboard. The illuminated keyboard includes a supporting plate, a transparent frame plate, a membrane switch circuit module, at least one key, a light source film layer and a light source. The transparent frame plate is disposed on the supporting plate. The membrane switch circuit module is disposed on the transparent frame plate. The key is connected with the transparent frame plate. When the key is pressed, the key is sustained against the membrane switch circuit module. The light source film layer is arranged between the key and the supporting plate, and has a light source circuit pattern. The light source is disposed on the light source film layer and connected with the light source circuit pattern. The light source is driven by the light source circuit pattern to emit a light beam.

In an embodiment, the light source film layer is arranged between the key and the membrane switch circuit module. The membrane switch circuit module includes an upper wiring board, a partition plate and a lower wiring board. The upper wiring board has at least one upper contact and an upper wiring board opening The light source is penetrated through the upper wiring board opening The partition plate is disposed under the upper wiring board, and has a first partition plate opening and a second partition plate opening When the membrane switch circuit module is pressed, the upper contact is inserted into the first partition plate opening The light source is penetrated through the second partition plate opening The lower wiring board is disposed under the partition plate, and has a lower contact corresponding to the upper contact and a lower wiring board opening to be penetrated by the light source. When the membrane switch circuit module is pressed, the upper contact is contacted with the lower contact. The light source is successively penetrated through the upper wiring board opening, the second partition plate opening and the lower wiring board opening, and inserted into the transparent frame plate.

In an embodiment, the light source film layer is arranged between the membrane switch circuit module and the transparent frame plate, and the transparent frame plate has a frame plate opening to be inserted by the light source.

In an embodiment, the light source film layer is arranged between the transparent frame plate and the supporting plate, and the transparent frame plate has a frame plate opening to be inserted by the light source.

In an embodiment, the illuminated keyboard further includes a light-guiding film layer, which is arranged beside the light source film layer for guiding the light beam, thereby changing a propagating direction of the light beam. The light-guiding film layer has a light-guiding film opening to be penetrated by the light source.

In an embodiment, the key includes a keycap, a scissors-type connecting member and an elastic element. The keycap is exposed to a surface of the illuminated keyboard, and includes a light-transmissible region. The scissors-type connecting member is arranged between the transparent frame plate and the keycap for connecting the transparent frame plate and the keycap, and allowing the keycap to be moved upwardly and downwardly with respect to the transparent frame plate. The elastic element is arranged between the membrane switch circuit module and the keycap. When the keycap is pressed, the elastic element is compressed and sustained against the membrane switch circuit module, so that the upper contact is contacted with the lower contact. When a pressing force exerted on the key is eliminated, an elastic force provided by the elastic element is acted on the keycap, so that the keycap is returned to an original position.

In an embodiment, the keycap includes a first keycap fixing structure and a second keycap fixing structure. The transparent frame plate includes a first frame plate fixing structure and a second frame plate fixing structure. The first frame plate fixing structure and the second frame plate fixing structure are integrally formed with the transparent frame plate. The scissors-type connecting member includes a first frame and a second frame. A first end of the first frame is connected with the second frame plate fixing structure, a second end of the first frame is connected with the first keycap fixing structure, a first end of the second frame is connected with the second keycap fixing structure, and a second end of the second frame is connected with the first frame plate fixing structure.

In accordance with a further aspect of the present invention, there is provided an illuminated keyboard. The illuminated keyboard includes a transparent frame plate, a membrane switch circuit module, an elastic film layer and a light source. The membrane switch circuit module is disposed on the transparent frame plate. The key is connected with the transparent frame plate. When the key is pressed, the key is sustained against the membrane switch circuit module. The elastic film layer is arranged between the membrane switch circuit and the key, and has a light source circuit pattern. The light source is disposed on the elastic film layer and connected with the light source circuit pattern. The light source is driven by the light source circuit pattern to emit a light beam.

In an embodiment, the membrane switch circuit module includes an upper wiring board, a partition plate and a lower wiring board. The upper wiring board has at least one upper contact and an upper wiring board opening. The light source is penetrated through the upper wiring board opening The partition plate is disposed under the upper wiring board, and has a first partition plate opening and a second partition plate opening When the membrane switch circuit module is pressed, the upper contact is inserted into the first partition plate opening The light source is penetrated through the second partition plate opening. The lower wiring board is disposed under the partition plate, and has a lower contact corresponding to the upper contact and a lower wiring board opening to be penetrated by the light source. When the membrane switch circuit module is pressed, the upper contact is contacted with the lower contact. The light source is successively penetrated through the upper wiring board opening, the second partition plate opening and the lower wiring board opening, and inserted into the transparent frame plate.

In an embodiment, the elastic film layer has an elastic film opening When the key is pressed and moved downwardly with respect to the transparent frame plate, the key is partially penetrated through the elastic film opening, so that the elastic element is sustained against the membrane switch circuit module.

In an embodiment, the key includes a keycap, a scissors-type connecting member and an elastic element. The keycap is exposed to a surface of the illuminated keyboard, and includes a light-transmissible region. The scissors-type connecting member is arranged between the transparent frame plate and the keycap for connecting the transparent frame plate and the keycap, and allowing the keycap to be moved upwardly and downwardly with respect to the transparent frame plate. The elastic element is disposed on the elastic film layer. When the keycap is pressed, the elastic element is compressed and sustained against the elastic film layer, so that the upper contact is contacted with the lower contact. When a pressing force exerted on the key is eliminated, an elastic force provided by the elastic element is acted on the keycap, so that the keycap is returned to an original position.

In an embodiment, the keycap includes a first keycap fixing structure and a second keycap fixing structure. The transparent frame plate includes a first frame plate fixing structure and a second frame plate fixing structure. The first frame plate fixing structure and the second frame plate fixing structure are integrally formed with the transparent frame plate. The scissors-type connecting member includes a first frame and a second frame. A first end of the first frame is connected with the second frame plate fixing structure, a second end of the first frame is connected with the first keycap fixing structure, a first end of the second frame is connected with the second keycap fixing structure, and a second end of the second frame is connected with the first frame plate fixing structure.

In an embodiment, the illuminated keyboard includes a supporting plate and a light-guiding film layer. The supporting plate is disposed under the transparent frame plate for reflecting the light beam and avoiding bending the transparent frame plate. The light-guiding film layer is arranged between the supporting plate and the transparent frame plate for guiding the light beam, thereby changing a propagating direction of the light beam.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
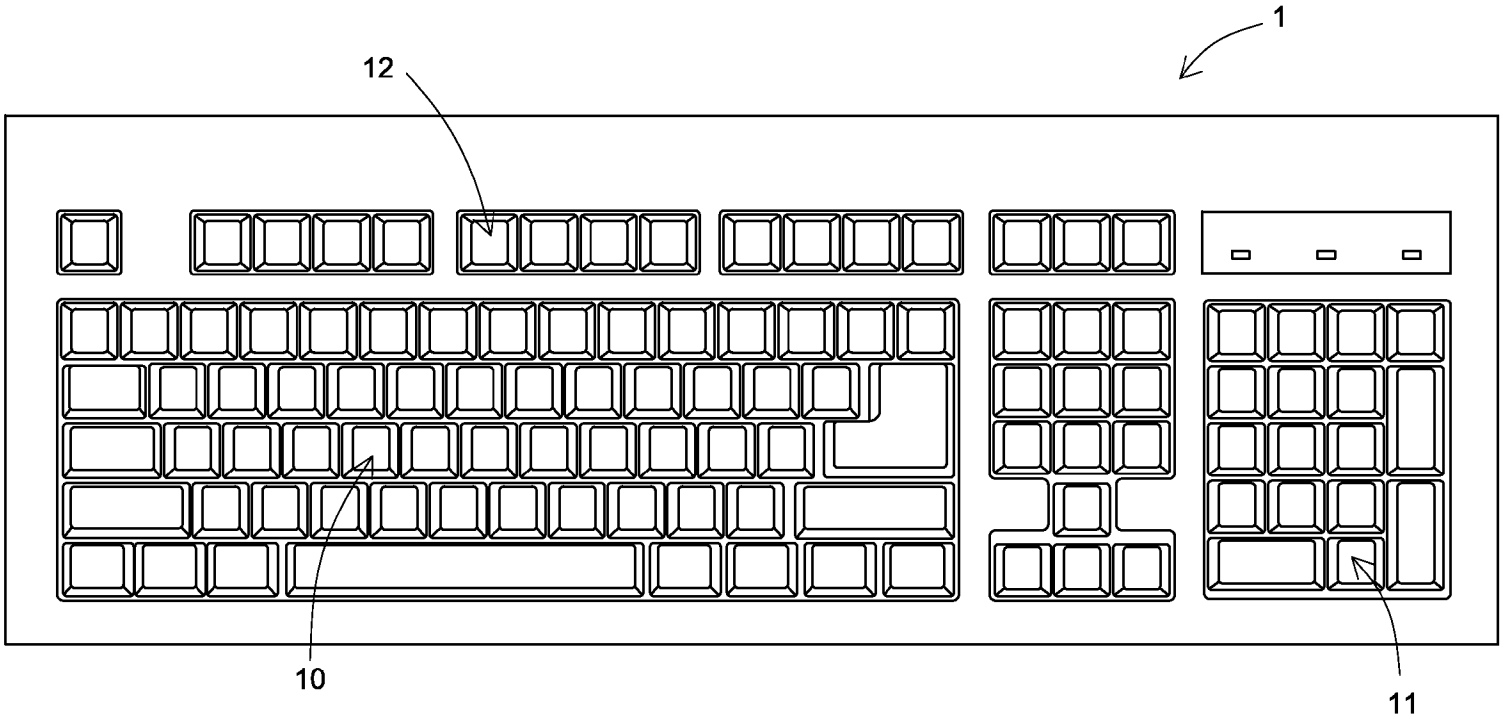
FIG. 1(PRIOR ART)
FIG. 1 is a schematic view illustrating the outward appearance of a conventional keyboard device.
Figure 2:
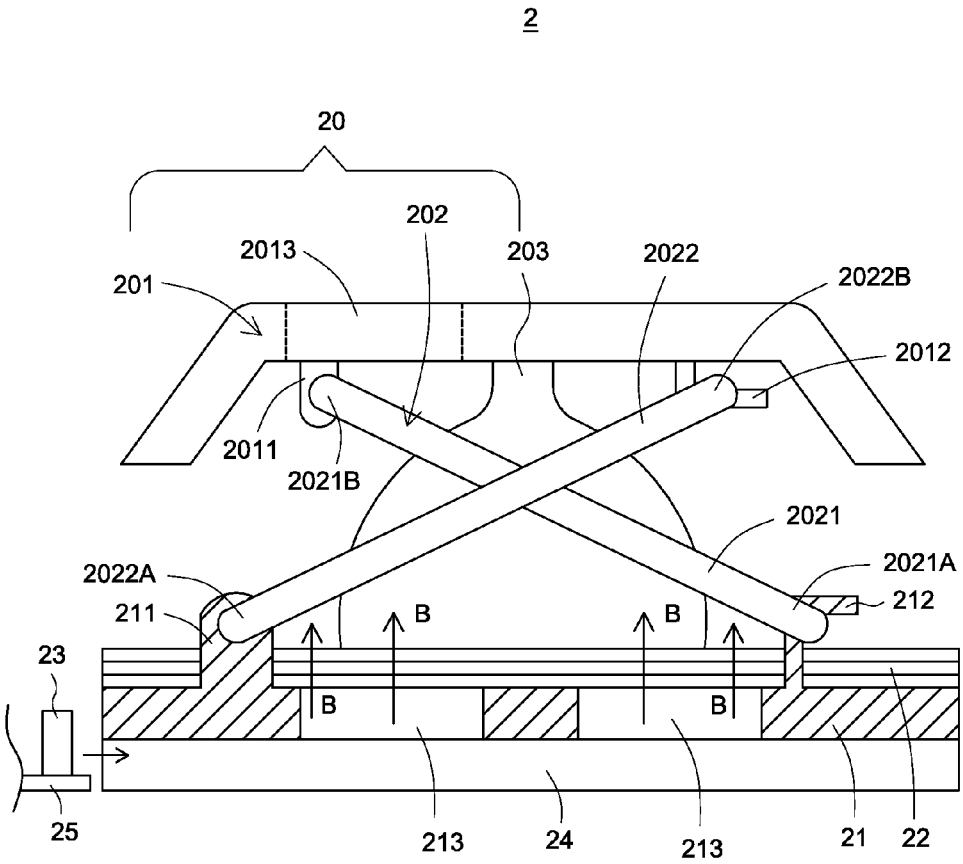
FIG. 2(PRIOR ART)
FIG. 2 is a schematic side view illustrating a conventional illuminated keyboard.
Figure 3:
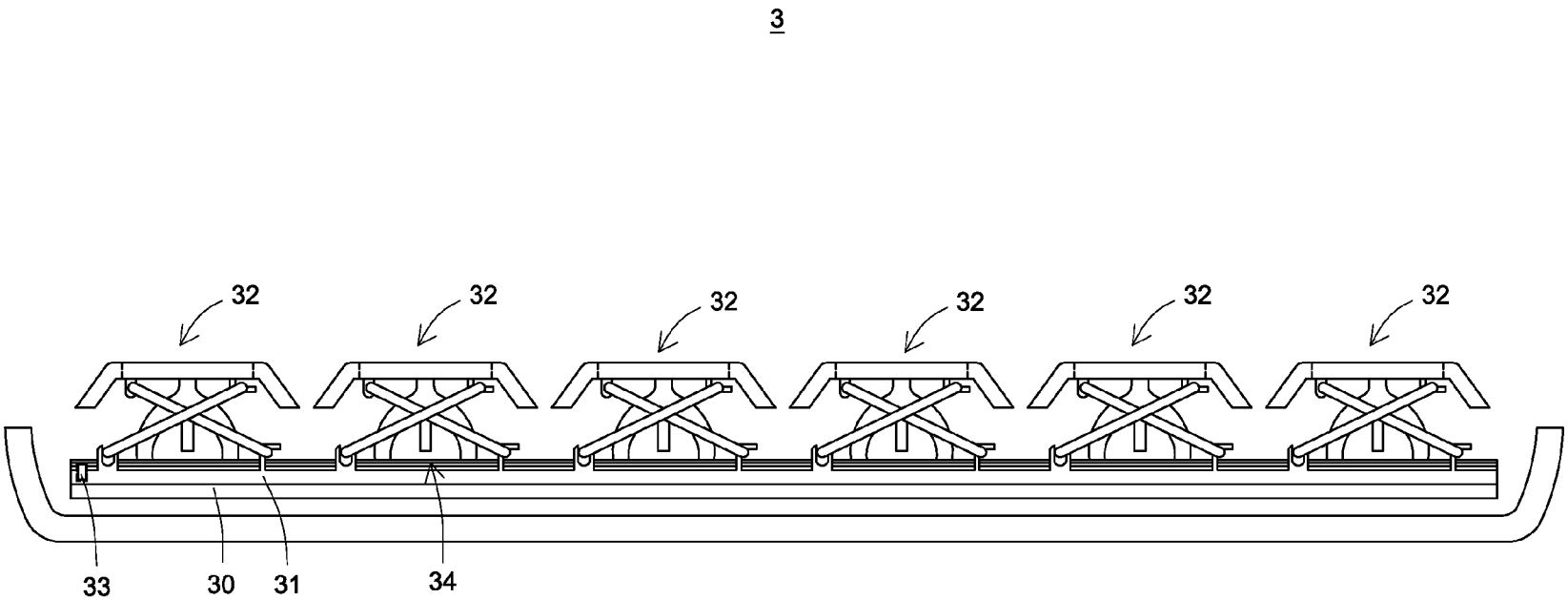
FIG. 3 is a schematic view illustrating an illuminated keyboard according to a first embodiment of the present invention.

For obviating the drawbacks encountered from the prior art, the present invention provides an illuminated keyboard. FIG. 3 is a schematic view illustrating an illuminated keyboard according to a first embodiment of the present invention. As shown in FIG. 3, the illuminated keyboard 3 comprises a supporting plate 30, a transparent frame plate 31, plural keys 32, a row of light sources 33 and a membrane switch circuit module 34. For clarification, only a light source 33 is shown in the drawing. The plural keys 32 are disposed on the membrane switch circuit module 34. The membrane switch circuit module 34 is disposed on the transparent frame plate 31. The transparent frame plate 31 is disposed on the supporting plate 30. An example of the light source 23 is a light emitting diode (LED). The number of light sources 33 is not equivalent to the number of keys 32. For the whole illuminated keyboard 3, the light beams emitted by the row of light sources 33 are sufficient to illuminate all of the keys 32.

Figure 4:
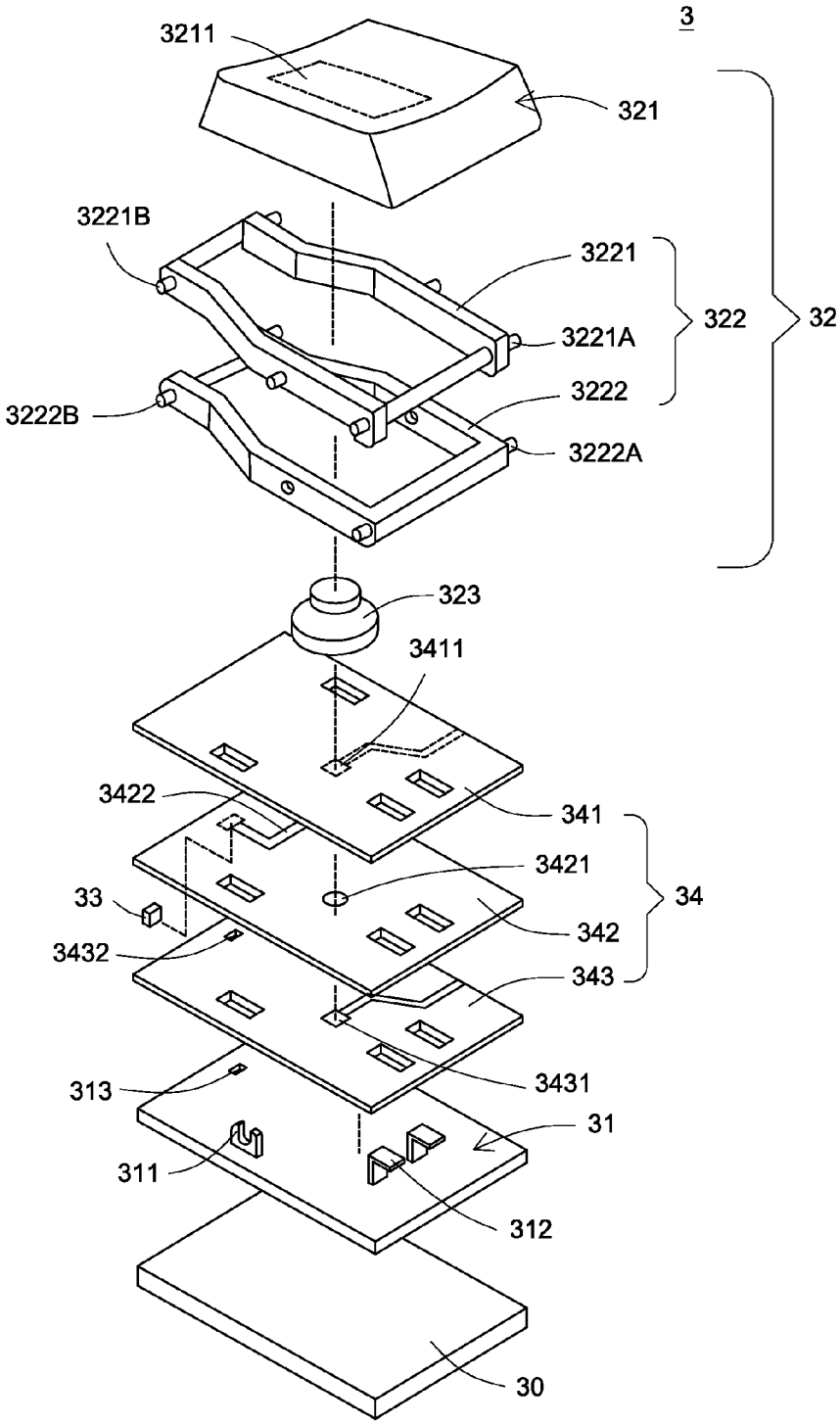
FIG. 4 is a schematic exploded view illustrating a portion of the illuminated keyboard according to the first embodiment of the present invention.

Hereinafter, the detailed configurations of the illuminated keyboard 3 will be illustrated by referring to a key 32 of FIG. 3 as well as FIG. 4. Please refer to FIG. 4, which is a schematic exploded view illustrating a portion of the illuminated keyboard according to the first embodiment of the present invention. In FIG. 4, a supporting plate 30, a transparent frame plate 31, a key 32, a light source 33 and a membrane switch circuit module 34 are shown. The transparent frame plate 31 comprises a first frame plate fixing structure 311, a second frame plate fixing structure 312 and a frame plate opening 313. It is preferred that the first frame plate fixing structure 311 and the second frame plate fixing structure 312 are integrally formed with the transparent frame plate 31. In this embodiment, the transparent frame plate 31 is made of a transparent material, so that the light beam is transmissible through the transparent frame plate 31 and not hindered by the transparent frame plate 31. Moreover, the key 32 comprises a keycap 321, a scissors-type connecting member 322 and an elastic element 323. The keycap 321 has a light-transmissible region 3211, which is arranged on a top surface of the keycap 321. The scissors-type connecting member 322 comprises a first frame 3221 and a second frame 3222. In addition, the elastic element 323 is a transparent rubbery element.

The light source 33 is arranged between the transparent frame plate 31 and the key 32. The light source 33 is used for emitting a light beam B' (see FIG. 5). The supporting plate 30 is used for reflecting the light beam B'. In this embodiment, the supporting plate 30 is made of a metallic material. In addition, the supporting plate 30 made of the metallic material should provide good optical reflectivity. The membrane switch circuit module 34 is arranged between the transparent frame plate 31 and the key 32. Moreover, the membrane switch circuit module 34 comprises an upper wiring board 341, a partition plate 342 and a lower wiring board 343. The upper wiring board 341 has at least one upper contact 3411. The partition plate 342 comprises a partition plate opening 3421 and a light source circuit pattern 3422. When the membrane switch circuit module 34 is pressed, the upper contact 3411 is inserted into the partition plate opening 3421. The light source 33 and the light source circuit pattern 3422 are disposed on the partition plate 342. In addition, the light source circuit pattern 3422 is connected with the light source 33 for driving the light source 33. The lower wiring board 343 has a lower contact 3431 corresponding to the upper contact 3411 and a lower wiring board opening 3432. When the membrane switch circuit module 34 is pressed, the upper contact 3411 will be contacted with the lower contact 3431. In addition, the light source 33 may be penetrated through the lower wiring board opening 3432.

Figure 5:
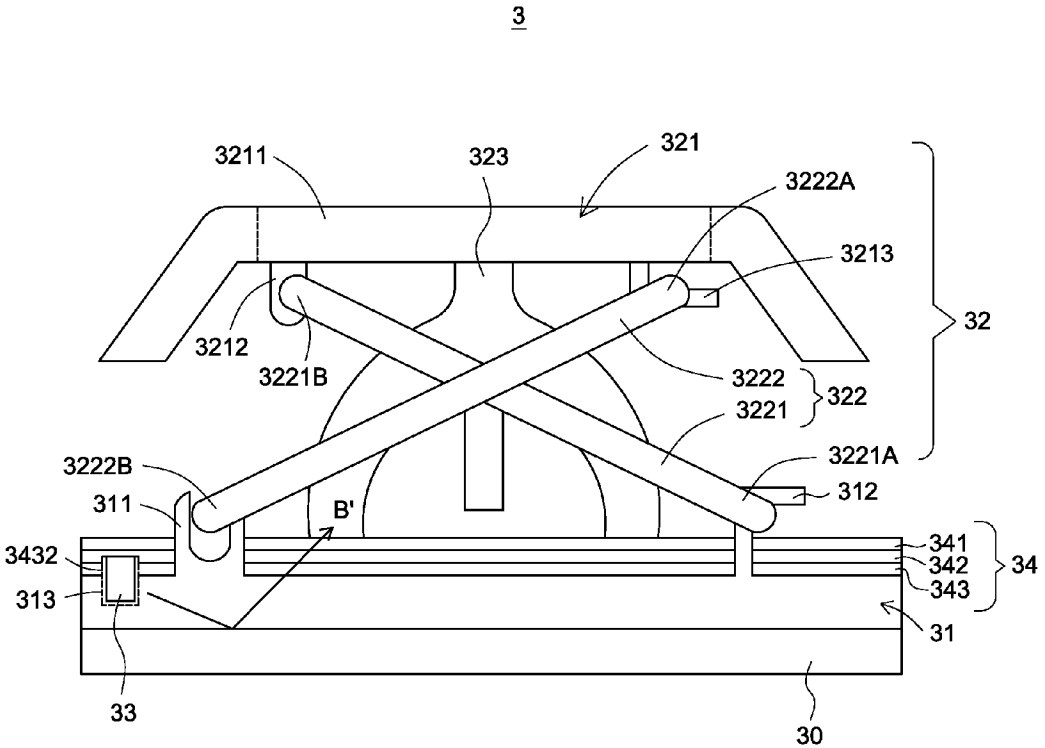
FIG. 5 is a schematic side view illustrating a portion of the illuminated keyboard according to the first embodiment of the present invention.

Hereinafter, the relations between the components of the illuminated keyboard 3 will be illustrated with reference to FIG. 5. FIG. 5 is a schematic side view illustrating a portion of the illuminated keyboard according to the first embodiment of the present invention. In the illuminated keyboard 3, the transparent frame plate 31 is disposed on the supporting plate 30. The supporting plate 30 may increase the structural strength of the transparent frame plate 31, so that the possibility of bending the transparent frame plate 31 is minimized. The membrane switch circuit module 34 is disposed on the transparent frame plate 31. The light source 33 is disposed on the partition plate 342 of the membrane switch circuit module 34. In the membrane switch circuit module 34, the upper wiring board 341 is laminated on the partition plate 342, and the partition plate 342 is laminated on the lower wiring board 343. Moreover, the light source 33 is penetrated through the lower wiring board opening 3432 and the frame plate opening 313. The elastic element 323 is disposed on the membrane switch circuit module 34. The keycap 321 is disposed on the elastic element 323. The scissors-type connecting member 322 is arranged between the transparent frame plate 31 and the keycap 321. The scissors-type connecting member 322 is used for connecting the transparent frame plate 31 and the keycap 321, and allowing the keycap 321 to be moved upwardly and downwardly with respect to the transparent frame plate 31. In the scissors-type connecting member 322, a first end 3221A of the first frame 3221 is connected with the second frame plate fixing structure 312, and a second end 3221B of the first frame 3221 is connected with a first keycap fixing structure 3212. In addition, a first end 3222A of the second frame 3222 is connected with a second keycap fixing structure 3213, and a second end 3222B of the second frame 3222 is connected with the first frame plate fixing structure 311.

Please refer to FIG. 5 again. When the key 32 is pressed and moved downwardly with respect to the transparent frame plate 31, the first frame 3221 and the second frame 3222 of the scissors-type connecting member 322 are switched from an open-scissors state to a stacked state. In addition, as the keycap 321 is moved downwardly to press the elastic element 323, the elastic element 323 is sustained against the membrane switch circuit module 34. In the membrane switch circuit module 34, the upper contact 3411 is inserted into the partition plate opening 3421 of the partition plate 342 to touch the lower contact 3431, so that electrical connection between the upper contact 3411 and the lower contact 3431 is established. Accordingly, a key signal corresponding to the pressed key 32 is generated. Whereas, when the pressing force exerted on the key 32 is eliminated, an elastic force provided by the elastic element 323 is acted on the keycap 321. Due to the elastic force, the keycap 321 is moved upwardly with respect to the transparent frame plate 31, and the first frame 3221 and the second frame 3222 of the scissors-type connecting member 322 are switched from the stacked state to the open-scissors state. Consequently, the keycap 321 is returned to its original position.

Please refer to FIG. 5 again. After the light beam B' is emitted by the light source 33, the light beam B' is projected downwardly and directed to the transparent frame plate 31, and propagated within the transparent frame plate 31. Then, the light beam B' passes through the transparent frame plate 31 and is reflected by the supporting plate 30, so that the propagating direction of the light beam B' is changed. Then, the light beam B' is directed to the membrane switch circuit module 34 through the transparent frame plate 31. After the light beam B' passes through the membrane switch circuit module 34, the light beam B' passes through the elastic element 323 and is directed to the keycap 321. Then, the light beam B' passes through the light-transmissible region 3211 of the keycap 321, thereby illuminating the illuminated keyboard 3.

From the above discussions, the light beam B' emitted by the source 33, which is arranged between the transparent frame plate 31 and the membrane switch circuit module 34, is propagated along an optical path. Along the optical path, the light beam B' is projected downwardly and directed to the transparent frame plate 31, reflected by the supporting plate 30, and directed upwardly to the transparent frame plate 31, the membrane switch circuit module 34 and the light-transmissible region 3211 of the keycap 321.

It is noted that the light-transmissible region 3211 of the keycap 321 is a character region or a symbol region at the surface of the keycap 321. For example, the light-transmissible region 3211 is an A-letter character region corresponding to the key A. Due to the above configurations, the light beam B' may pass through the light-transmissible region 3211, thereby illuminating the character region or the symbol region of the key 32.

Figure 6:
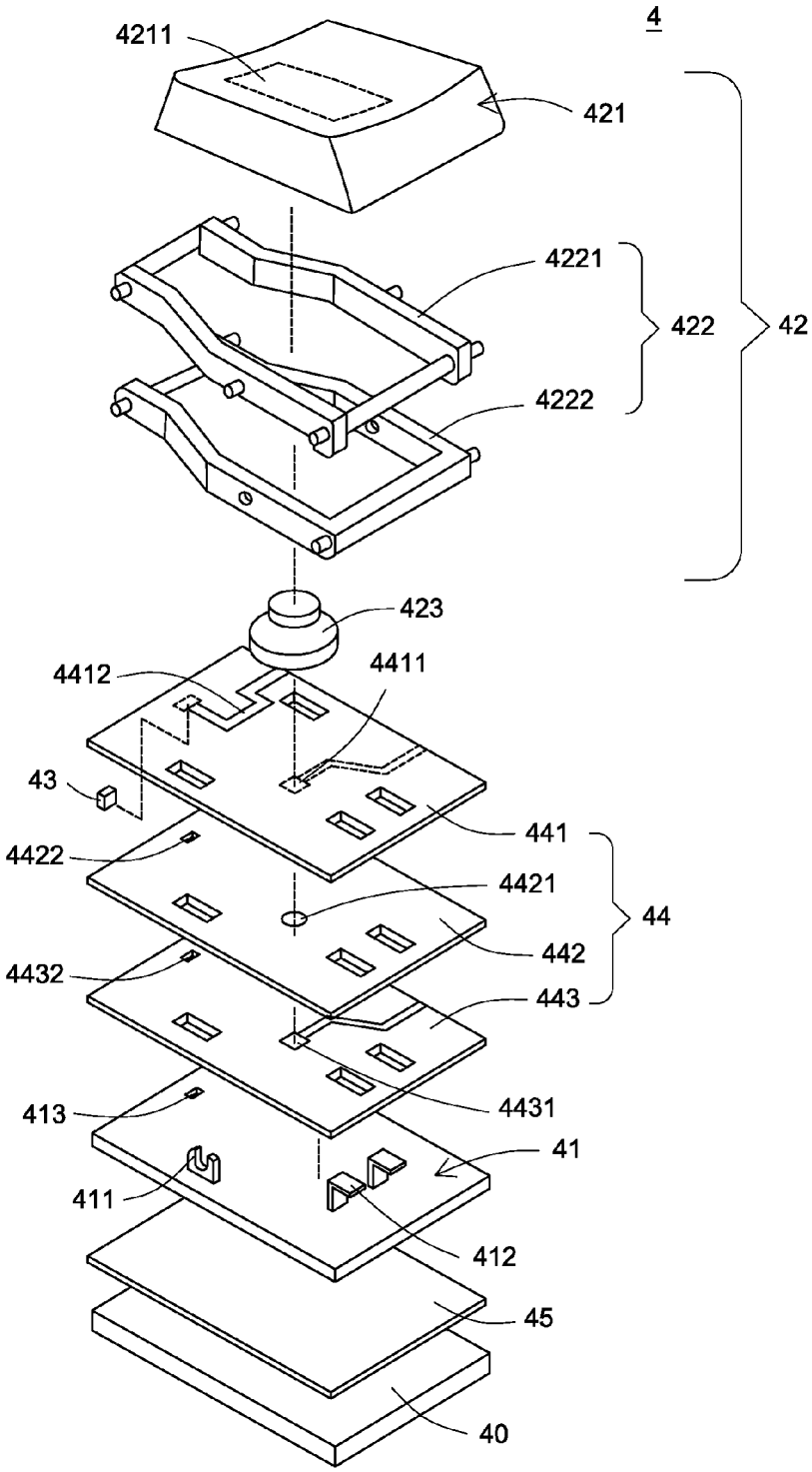
FIG. 6 is a schematic exploded view illustrating a portion of the illuminated keyboard according to a second embodiment of the present invention.

The present invention further provides a second embodiment of an illuminated keyboard. FIG. 6 is a schematic exploded view illustrating a portion of the illuminated keyboard according to a second embodiment of the present invention. As shown in FIG. 6, the illuminated keyboard 4 comprises a supporting plate 40, a transparent frame plate 41, at least one key 42 (only a key 42 is shown), a light source 43, a membrane switch circuit module 44 and a light-guiding film layer 45. The transparent frame plate 41 comprises a first frame plate fixing structure 411, a second frame plate fixing structure 412 and a frame plate opening 413. It is preferred that the first frame plate fixing structure 411 and the second frame plate fixing structure 412 are integrally formed with the transparent frame plate 41. In this embodiment, the transparent frame plate 41 is made of a transparent material, so that the light beam is transmissible through the transparent frame plate 41 and not hindered by the transparent frame plate 41. Moreover, the key 42 comprises a keycap 421, a scissors-type connecting member 422 and an elastic element 423. The keycap 421 has a light-transmissible region 4211, which is arranged on a top surface of the keycap 421. The scissors-type connecting member 422 comprises a first frame 4221 and a second frame 4222. In addition, the elastic element 423 is a transparent rubbery element.

Figure 7:
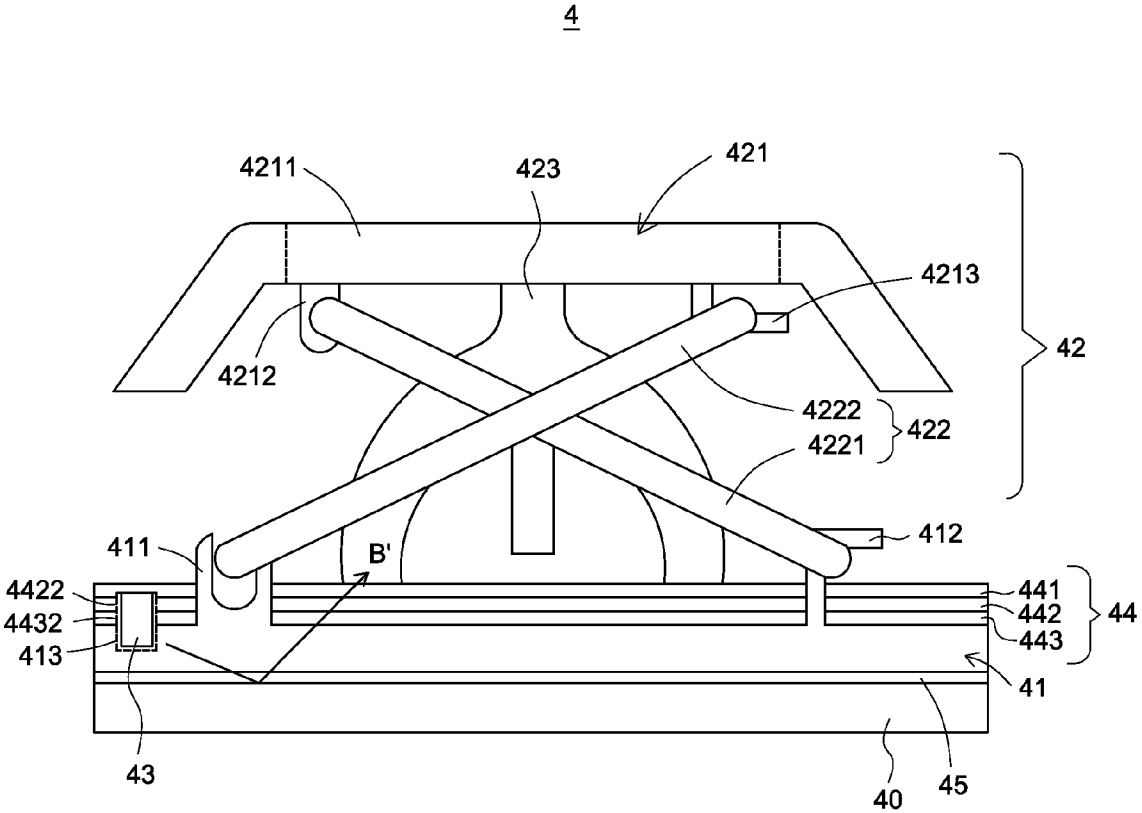
FIG. 7 is a schematic side view illustrating a portion of the illuminated keyboard according to the second embodiment of the present invention.

The light source 43 is used for emitting a light beam B' (see FIG. 7). An example of the light source 43 is a light emitting diode (LED). The supporting plate 40 is used for reflecting the light beam B'. The membrane switch circuit module 44 is arranged between the transparent frame plate 41 and the key 42. In addition, the membrane switch circuit module 44 comprises an upper wiring board 441, a partition plate 442 and a lower wiring board 443. The upper wiring board 441 has at least one upper contact 4411 and a light source circuit pattern 4412. The light source 43 and the light source circuit pattern 4412 are disposed on the upper wiring board 441. In addition, the light source circuit pattern 4412 is connected with the light source 43 for driving the light source 43. The partition plate 442 comprises a first partition plate opening 4421 and a second partition plate opening 4422. When the membrane switch circuit module 44 is pressed, the upper contact 4411 may be inserted into the first partition plate opening 4421. In addition, the light source 43 may be penetrated through the second partition plate opening 4422. The lower wiring board 443 has a lower contact 4431 corresponding to the upper contact 4411 and a lower wiring board opening 4432. When the membrane switch circuit module 44 is pressed, the upper contact 4411 will be contacted with the lower contact 4431. In addition, the light source 43 may be penetrated through the lower wiring board opening 4432. The light-guiding film layer 45 is used to guide the light beam B', so that the light beam B' can be diffused to the transparent frame plate 41 that is under other keys 42 or the propagating direction of the light beam B' can be changed.

Hereinafter, the relations between the components of the illuminated keyboard 4 will be illustrated with reference to FIG. 7. FIG. 7 is a schematic side view illustrating a portion of the illuminated keyboard according to the second embodiment of the present invention. In the illuminated keyboard 4, the transparent frame plate 41 is disposed on the supporting plate 40. The supporting plate 40 may increase the structural strength of the transparent frame plate 41, so that the possibility of bending the transparent frame plate 41 is minimized. The light-guiding film layer 45 is arranged between the supporting plate 40 and the transparent frame plate 41. The membrane switch circuit module 44 is disposed on the transparent frame plate 41. The light source 43 is disposed on the upper wiring board 441 of the membrane switch circuit module 44. In the membrane switch circuit module 44, the upper wiring board 441 is laminated on the partition plate 442, and the partition plate 442 is laminated on the lower wiring board 443. Moreover, the light source 43 is penetrated through the second partition plate opening 4422, the lower wiring board opening 4432 and the frame plate opening 413. The keycap 421 is disposed on the elastic element 423. The elastic element 423 is disposed on the membrane switch circuit module 44. When the keycap 421 is pressed and the elastic element 423 is compressed, the elastic element 423 is sustained against the membrane switch circuit module 44, which is disposed under the elastic element 423. In the membrane switch circuit module 44, the upper contact 4411 is inserted into the first partition plate opening 4421 to touch the lower contact 4431, so that electrical connection between the upper contact 4411 and the lower contact 4431 is established. Accordingly, a key signal corresponding to the pressed key 42 is generated. The scissors-type connecting member 422 is arranged between the transparent frame plate 41 and the keycap 421. The scissors-type connecting member 422 is used for connecting the transparent frame plate 41 and the keycap 421, and allowing the keycap 421 to be moved upwardly and downwardly with respect to the transparent frame plate 41. The relations between the first frame 4221 and the second frame 4222 of the scissors-type connecting member 422 and the transparent frame plate 41 and the keycap 421 are similar to those of the first embodiment, and are not redundantly described herein.

Please refer to FIG. 7 again. When the key 42 is pressed and moved downwardly with respect to the transparent frame plate 41, the first frame 4221 and the second frame 4222 of the scissors-type connecting member 422 are switched from an open-scissors state to a stacked state. In addition, as the keycap 421 is moved downwardly to press the elastic element 423, the elastic element 423 is sustained against the membrane switch circuit module 44, and the upper contact 4411 of the upper wiring board 441 and the lower contact 4431 of the lower wiring board 443 are electrically connected with each other. Consequently, a key signal corresponding to the pressed key 42 is generated. Whereas, when the pressing force exerted on the key 42 is eliminated, an elastic force provided by the elastic element 423 is acted on the keycap 421. Due to the elastic force, the keycap 421 is moved upwardly with respect to the transparent frame plate 41, and the first frame 4221 and the second frame 4222 of the scissors-type connecting member 422 are switched from the stacked state to the open-scissors state. Consequently, the keycap 421 is returned to its original position.

After the light beam B' is emitted by the light source 43, the light beam B' is projected downwardly and directed to the transparent frame plate 41, and propagated within the transparent frame plate 41. Then, the light beam B' passing through the transparent frame plate 41 is incident into the light-guiding film layer 45. The light beam B' passing through the light-guiding film layer 45 is reflected by the supporting plate 40, so that the propagating direction of the light beam B' is changed. Then, the light beam B' is directed to the membrane switch circuit module 44 through the light-guiding film layer 45 and the transparent frame plate 41. After the light beam B' passes through the membrane switch circuit module 44 and the elastic element 423, the light beam B' is directed to the keycap 421. Then, the light beam B' passes through the light-transmissible region 4211 of the keycap 421, thereby illuminating the illuminated keyboard 4. The portion of the light beam B' that is not transmitted through the light-guiding film layer 45 and not reflected by the supporting plate 40 will be guided by the light-guiding film layer 45, so that the light beam B' will be diffused to the transparent frame plate 41 under other keys 42.

From the above discussions, if the influence of the light-guiding film layer 45 to guide the light beam B' is neglected, the light beam B' emitted by the source 43, which is arranged between the transparent frame plate 41 and the membrane switch circuit module 44, is propagated along an optical path. Along the optical path, the light beam B' is projected downwardly and directed to the transparent frame plate 41, incident downwardly into the light-guiding film layer 45, reflected by the supporting plate 40, incident upwardly into the light-guiding film layer 45, and directed upwardly to the transparent frame plate 41, the membrane switch circuit module 44 and the light-transmissible region 4211 of the keycap 421.

In this embodiment, since the light-guiding film layer 45 is arranged between the transparent frame plate 41 and the supporting plate 40, the light beam B' can be diffused to the transparent frame plate 41 under other keys 42. As a consequence, the illuminated keyboard 4 can be illuminated in a more uniform fashion.

Figure 8:
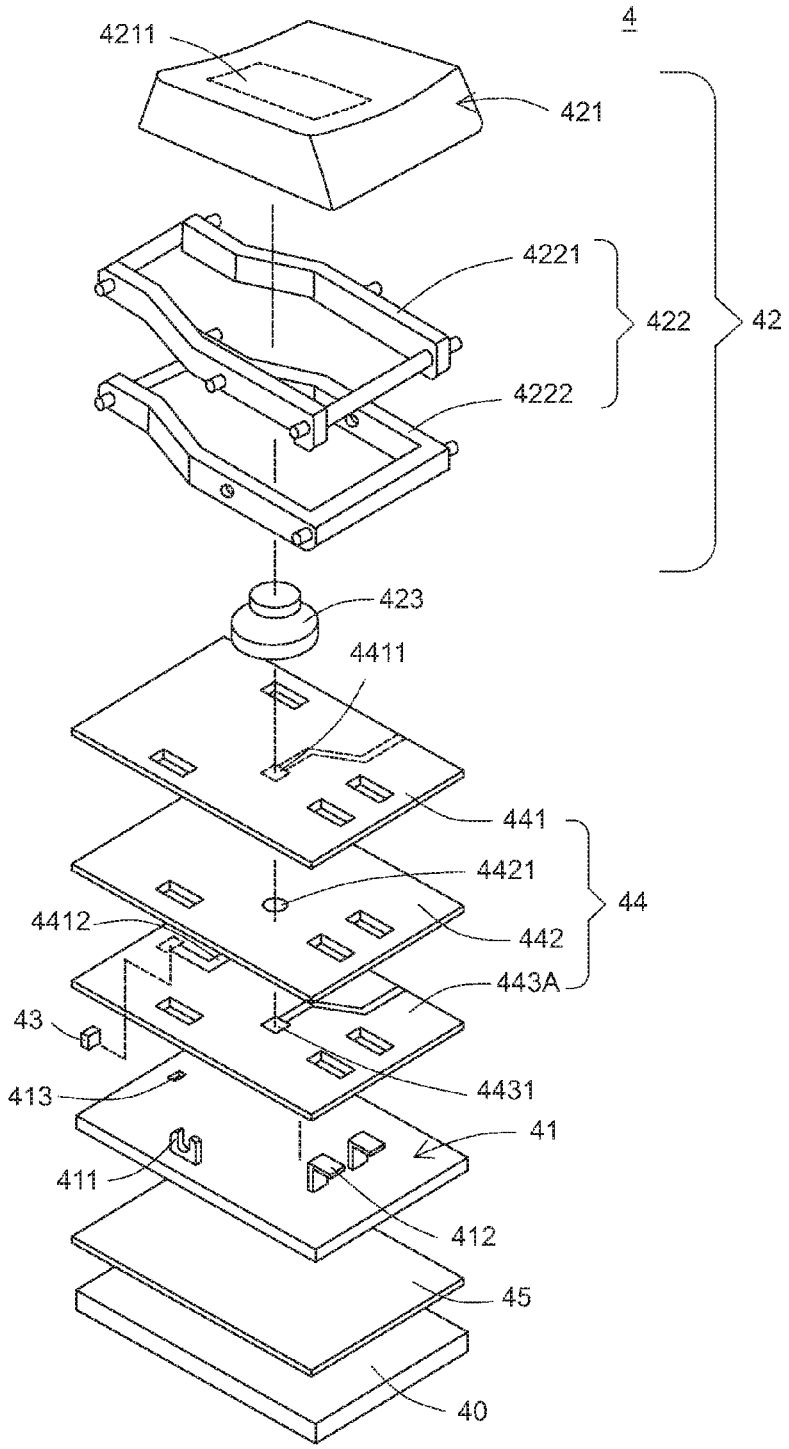
FIG. 8 is a schematic exploded view illustrating a portion of the illuminated keyboard according to another embodiment of the present invention, wherein the light source and the light source circuit pattern are disposed on the lower wiring board.

It is noted that, however, those skilled in the art will readily observe that numerous modifications and alterations may be made while retaining the teachings of the invention. For example, in some embodiments, as shown in FIG. 8, the light source 43 and the light source circuit pattern 4412 may be disposed on the lower wiring board 443A of the membrane switch circuit module. In this situation, the lower wiring board opening 4432 of the lower wiring board 443A is omitted. The configurations of other components are similar to those illustrated in the above embodiments, and are not redundantly described herein.

Figure 9:
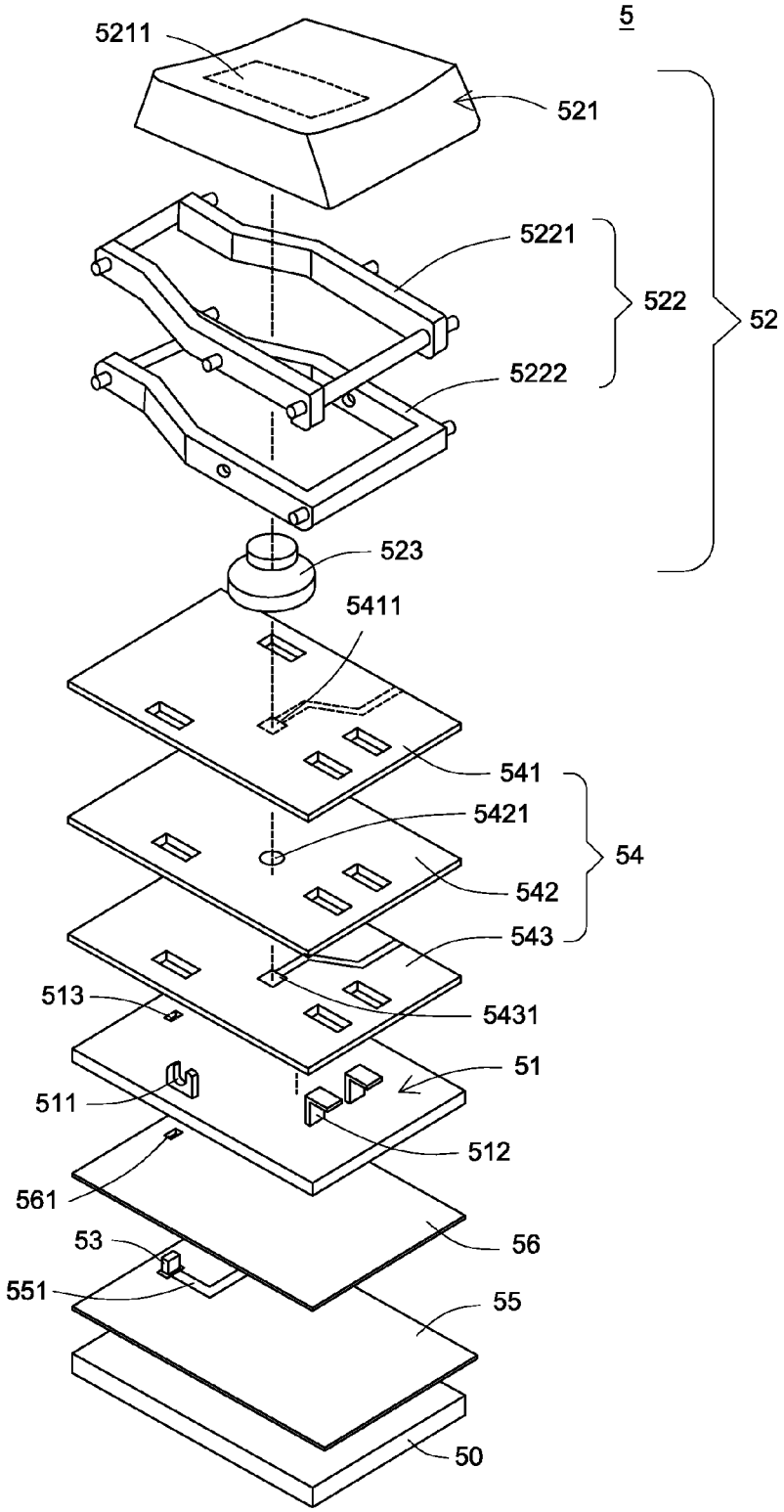
FIG. 9 is a schematic exploded view illustrating a portion of the illuminated keyboard according to a third embodiment of the present invention.

The present invention further provides a third embodiment of an illuminated keyboard. FIG. 9 is a schematic exploded view illustrating a portion of the illuminated keyboard according to a third embodiment of the present invention. As shown in FIG. 9, the illuminated keyboard 5 comprises a supporting plate 50, a transparent frame plate 51, at least one key 52 (only a key 52 is shown), a light source 53, a membrane switch circuit module 54, a light source film layer 55 and a light-guiding film layer 56. The transparent frame plate 51 comprises a first frame plate fixing structure 511, a second frame plate fixing structure 512 and a frame plate opening 513. It is preferred that the first frame plate fixing structure 511 and the second frame plate fixing structure 512 are integrally formed with the transparent frame plate 51. In this embodiment, the transparent frame plate 51 is made of a transparent material, so that the light beam is transmissible through the transparent frame plate 51 and not hindered by the transparent frame plate 51. Moreover, the key 52 comprises a keycap 521, a scissors-type connecting member 522 and an elastic element 523. The keycap 521 has a light-transmissible region 5211, which is arranged on a top surface of the keycap 521. The scissors-type connecting member 522 comprises a first frame 5221 and a second frame 5222. In addition, the elastic element 523 is a transparent rubbery element.

The supporting plate 50 is disposed under the transparent frame plate 51 for reflecting a light beam B'. The membrane switch circuit module 54 is arranged between the transparent frame plate 51 and the key 52. In addition, the membrane switch circuit module 54 comprises an upper wiring board 541, a partition plate 542 and a lower wiring board 543. The upper wiring board 541 has at least one upper contact 5411. The partition plate 542 has a partition plate opening 5421. When the membrane switch circuit module 54 is pressed, the upper contact 5411 is inserted into the first partition plate opening 5421. The lower wiring board 543 has a lower contact 5431 corresponding to the upper contact 5411. When the membrane switch circuit module 54 is pressed, the upper contact 5411 will be contacted with the lower contact 5431. The light source film layer 55 is arranged between the supporting plate 50 and the transparent frame plate 51. In addition, the light source film layer 55 has a light source circuit pattern 551. The light source 53 is disposed on the light source film layer 55 and connected with the source circuit pattern 5412. The source circuit pattern 5412 is used for driving the light source 53 to emit the light beam B' (see FIG. 10). In this embodiment, the light source film layer 55 is a transparent Mylar film, so that the light beam B' is transmissible through the light source film layer 55. An example of the light source 53 is a light emitting diode (LED). The light-guiding film layer 56 is arranged beside the light source film layer 55. In this embodiment, the light-guiding film layer 56 is disposed on the light source film layer 55 for guiding the light beam B', thereby changing the propagating direction of the light beam B'. Moreover, the light-guiding film layer 56 has a light-guiding film opening 561. The light source 53 may be penetrated through the light-guiding film opening 561.

Figure 10:
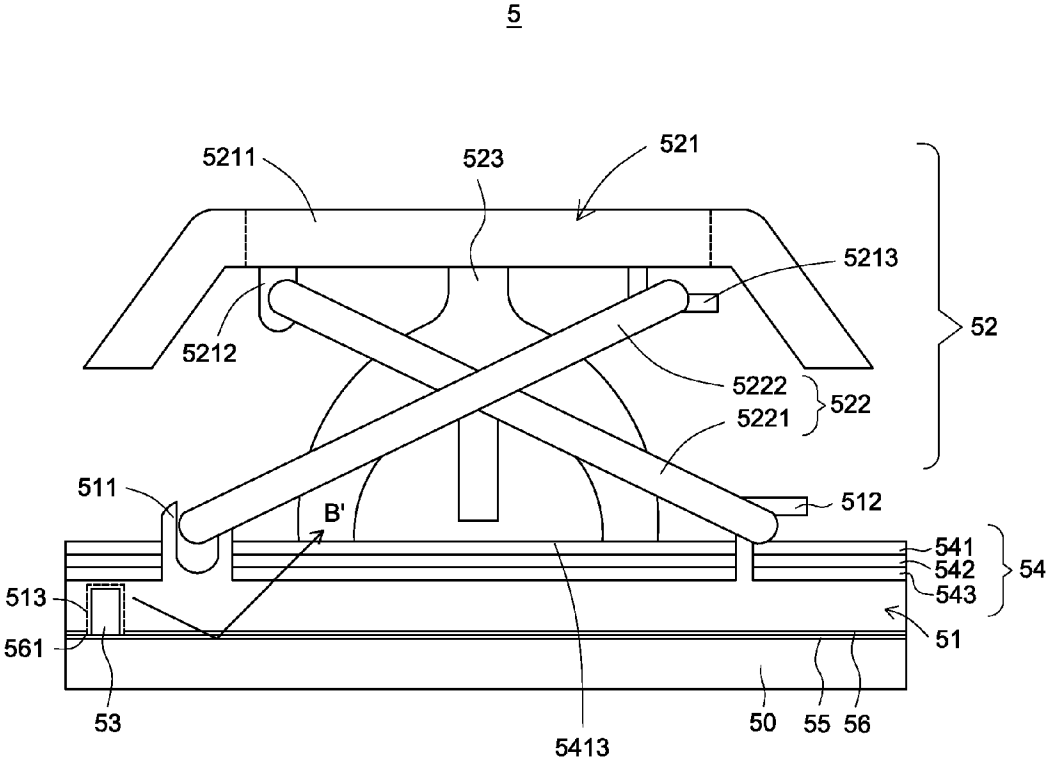
FIG. 10 is a schematic side view illustrating a portion of the illuminated keyboard according to the third embodiment of the present invention.

Hereinafter, the relations between the components of the illuminated keyboard 4 will be illustrated with reference to FIG. 10. FIG. 10 is a schematic side view illustrating a portion of the illuminated keyboard according to the third embodiment of the present invention. In the illuminated keyboard 5, the transparent frame plate 51 is disposed on the supporting plate 50. The supporting plate 50 may increase the structural strength of the transparent frame plate 51, so that the possibility of bending the transparent frame plate 51 is minimized. The light source film layer 55 is arranged between the supporting plate 50 and the transparent frame plate 51. The light-guiding film layer 56 is disposed on the light source film layer 55. The light source 53 is penetrated through the light-guiding film opening 561 and the frame plate opening 513, and inserted into the transparent frame plate 51. The membrane switch circuit module 54 is disposed on the transparent frame plate 51. In the membrane switch circuit module 54, the upper wiring board 541 is laminated on the partition plate 542, and the partition plate 542 is laminated on the lower wiring board 543. The keycap 521 is disposed on the elastic element 523. The elastic element 523 is disposed on the membrane switch circuit module 54. When the keycap 521 is pressed and the elastic element 523 is compressed, the elastic element 523 is sustained against the membrane switch circuit module 54, which is disposed under the elastic element 523. In the membrane switch circuit module 54, the upper contact 5411 is inserted into the partition plate opening 5421 to touch the lower contact 5431, so that electrical connection between the upper contact 5411 and the lower contact 5431 is established. Accordingly, a key signal corresponding to the pressed key 52 is generated. The scissors-type connecting member 522 is arranged between the transparent frame plate 51 and the keycap 521. The scissors-type connecting member 522 is used for connecting the transparent frame plate 51 and the keycap 521, and allowing the keycap 521 to be moved upwardly and downwardly with respect to the transparent frame plate 51. The relations between the first frame 5221 and the second frame 5222 of the scissors-type connecting member 522 and the transparent frame plate 51 and the keycap 521 and the operations of the pressed key 52 are similar to those of the first embodiment, and are not redundantly described herein.

After the light beam B' is emitted by the light source 53, the light beam B' is projected downwardly and directed to the transparent frame plate 51, and propagated within the transparent frame plate 51. Then, the light beam B' passing through the transparent frame plate 51 is incident into the light-guiding film layer 56. The light beam B' passing through the light-guiding film layer 56 is incident into the light source film layer 55. The light beam B' passing through the light source film layer 55 is reflected by the supporting plate 50, so that the propagating direction of the light beam B' is changed. Then, the light beam B' is directed to the membrane switch circuit module 54 through the light source film layer 55, the light-guiding film layer 56 and the transparent frame plate 51. After the light beam B' passes through the membrane switch circuit module 54 and the elastic element 523, the light beam B' is directed to the keycap 521. Then, the light beam B' passes through the light-transmissible region 5211 of the keycap 521, thereby illuminating the illuminated keyboard 5. The portion of the light beam B' that is not transmitted through the light-guiding film layer 56 and not reflected by the supporting plate 50 will be guided by the light-guiding film layer 56, so that the light beam B' will be diffused to the transparent frame plate 51 under other keys 52.

From the above discussions, if the influence of the light-guiding film layer 56 to guide the light beam B' is neglected, the light beam B' emitted by the source 53, which is arranged between the transparent frame plate 51 and the membrane switch circuit module 54, is propagated along an optical path. Along the optical path, the light beam B' is projected downwardly and directed to the transparent frame plate 51, incident downwardly into the light-guiding film layer 56, incident downwardly into the light source film layer 55, reflected by the supporting plate 50, incident upwardly into the light source film layer 55, incident upwardly into the light-guiding film layer 56, and directed upwardly to the transparent frame plate 51, the membrane switch circuit module 54 and the light-transmissible region 5211 of the keycap 521.

In this embodiment, since the light source 53 is disposed on the light source film layer 55 rather than the membrane switch circuit module 54, any commercially available membrane switch circuit module may be used as the membrane switch circuit module 54 of the illuminated keyboard 5. In this situation, the opening of the membrane switch circuit module 54 for accommodating the light source 53 may be omitted.

Figure 11:
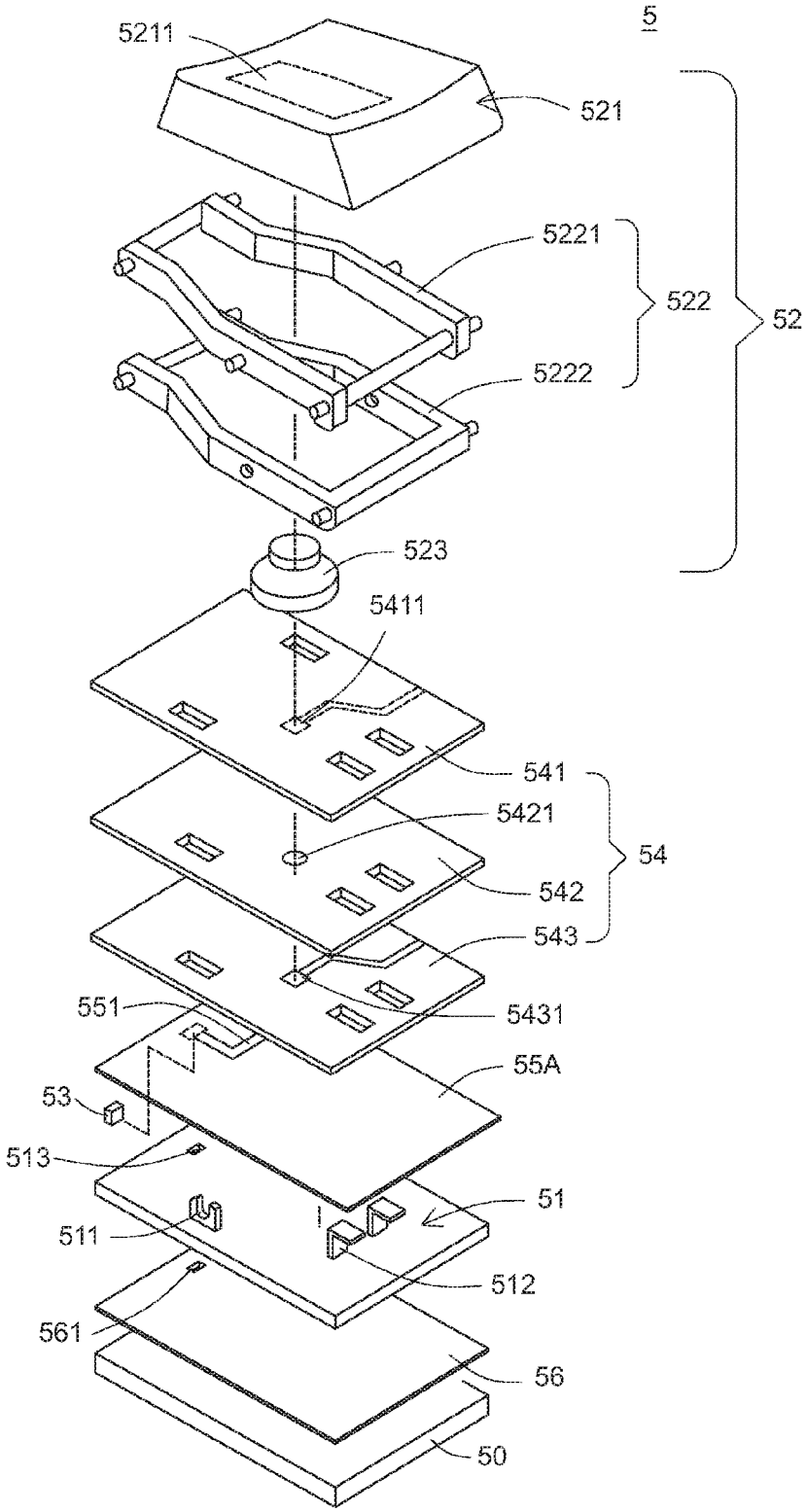
FIG. 11 is a schematic exploded view illustrating a portion of the illuminated keyboard according to another embodiment of the present invention, wherein the light source film layer is arranged between the membrane switch circuit module and the transparent frame plate.

It is noted that, however, those skilled in the art will readily observe that numerous modifications and alterations may be made while retaining the teachings of the invention. For example, in some embodiments, as shown in FIG. 11, the light source film layer 55A is arranged between the membrane switch circuit module 54 and the transparent frame plate 51. Except that the light source 53 is disposed on the bottom surface of the light source film layer 55A and inserted into the frame plate opening 513 of the transparent frame plate 51, the configurations of other components are similar to those illustrated in the above embodiments. Alternatively, in some embodiments, the light source film layer is arranged between the key and the membrane switch circuit module and. In this situation, the membrane switch circuit module may have openings corresponding to the light source. In addition, the light source is disposed on the bottom surface of the light source film layer, and inserted into corresponding openings of the membrane switch circuit module. The configurations of other embodiments are similar to those illustrated in the above embodiments, and are not redundantly described herein.

Figure 12:
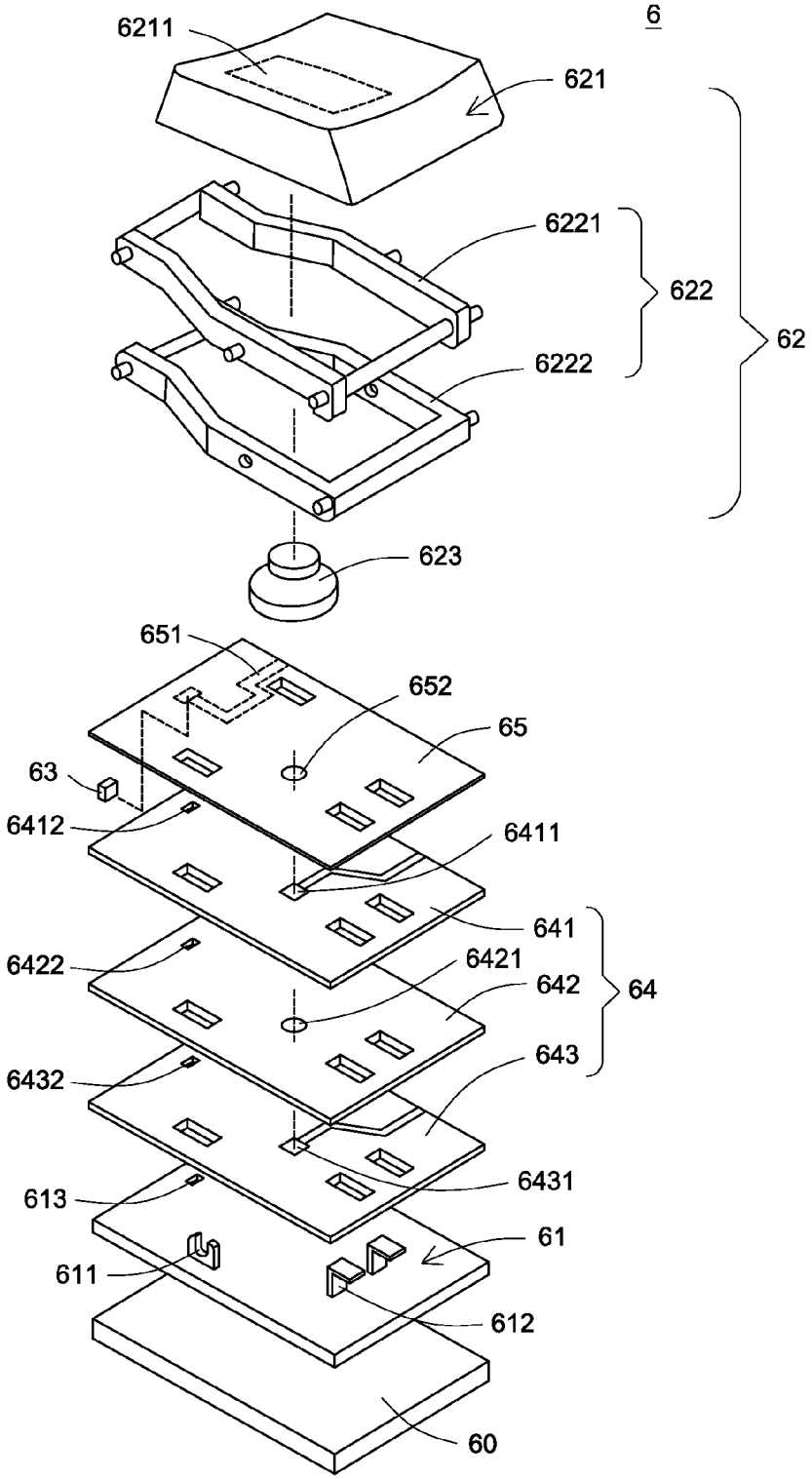
FIG. 12 is a schematic exploded view illustrating a portion of the illuminated keyboard according to a fourth embodiment of the present invention.

The present invention further provides a fourth embodiment of an illuminated keyboard. FIG. 12 is a schematic exploded view illustrating a portion of the illuminated keyboard according to a fourth embodiment of the present invention. As shown in FIG. 12, the illuminated keyboard 6 comprises a supporting plate 60, a transparent frame plate 61, at least one key 62 (only a key 62 is shown), a light source 63, a membrane switch circuit module 64, an elastic film layer 65. The transparent frame plate 61 comprises a first frame plate fixing structure 611, a second frame plate fixing structure 612 and a frame plate opening 613. It is preferred that the first frame plate fixing structure 611 and the second frame plate fixing structure 612 are integrally formed with the transparent frame plate 61. In this embodiment, the transparent frame plate 61 is made of a transparent material, so that the light beam is transmissible through the transparent frame plate 61 and not hindered by the transparent frame plate 61. Moreover, the key 62 comprises a keycap 621, a scissors-type connecting member 622 and an elastic element 623. The keycap 621 has a light-transmissible region 6211, which is arranged on a top surface of the keycap 621. The scissors-type connecting member 622 comprises a first frame 6221 and a second frame 6222. In addition, the elastic element 623 is a transparent rubbery element.

The elastic film layer 65 is arranged between the membrane switch circuit module 64 and the key 62. The elastic film layer 65 has a light source circuit pattern 651 and an elastic film opening 652. The light source 63 is disposed on the elastic film layer 65 and connected with the source circuit pattern 651. The source circuit pattern 651 is used for driving the light source 63 to emit a light beam B' (see FIG. 13). In this embodiment, the elastic film layer 65 is a transparent Mylar film. An example of the light source 63 is a light emitting diode (LED). The elastic element 623 is disposed on the elastic film layer 65. As the elastic element 623 is pressed, the elastic element 623 is partially penetrated through the elastic film opening 652, so that the elastic element 623 is sustained against the membrane switch circuit module 64. In this embodiment, the elastic element 623 is fixed on the elastic film layer 65 via an adhesive.

The transparent frame plate 61 is disposed under the membrane switch circuit module 64. The supporting plate 60 is disposed under the transparent frame plate 61 for reflecting the light beam B'. The membrane switch circuit module 64 is arranged between the transparent frame plate 61 and the key 62. In addition, the membrane switch circuit module 64 comprises an upper wiring board 641, a partition plate 642 and a lower wiring board 643. The upper wiring board 641 has at least one upper contact 6411 and an upper wiring board opening 6412. The partition plate 642 comprises a first partition plate opening 6421 and a second partition plate opening 6422. When the membrane switch circuit module 64 is pressed, the upper contact 6411 may be inserted into the first partition plate opening 6421. In addition, the light source 63 may be penetrated through the second partition plate opening 6422. The lower wiring board 643 has a lower contact 6431 corresponding to the upper contact 6411 and a lower wiring board opening 6432. When the membrane switch circuit module 64 is pressed, the upper contact 6411 will be contacted with the lower contact 6431. The light source 63 may be penetrated through the lower wiring board opening 6432.

Figure 13:
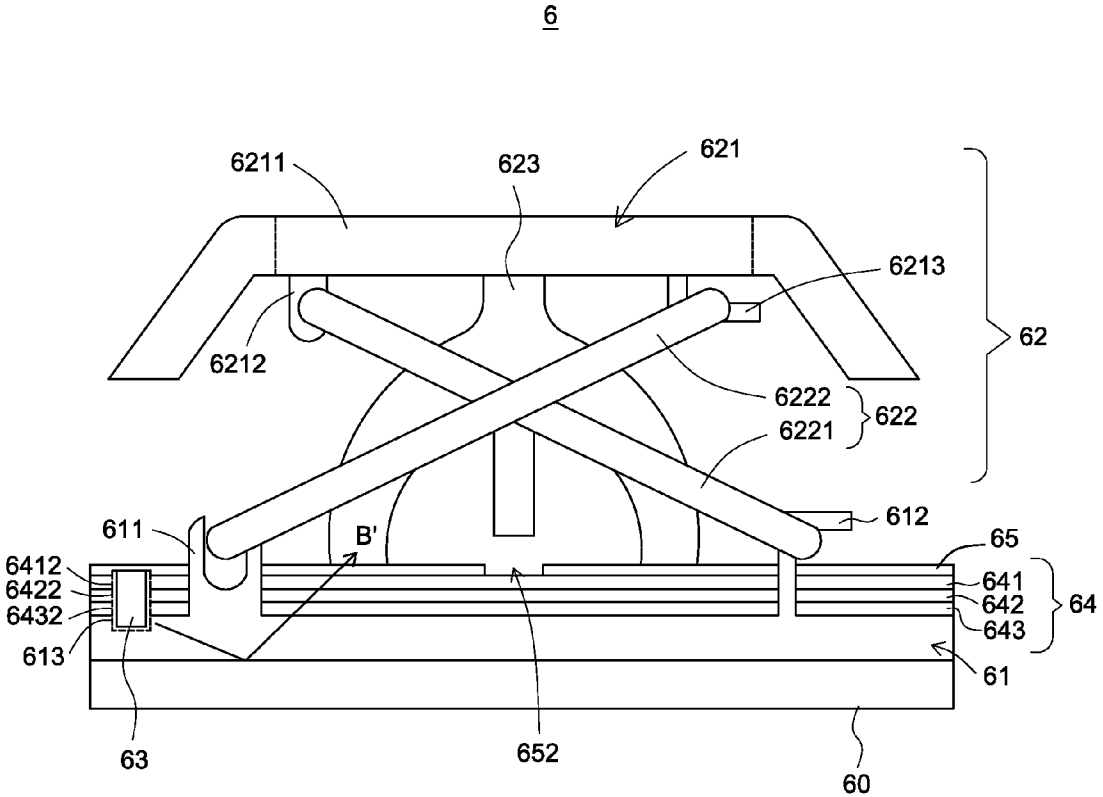
FIG. 13 is a schematic side view illustrating a portion of the illuminated keyboard according to the fourth embodiment of the present invention.

FIG. 13 is a schematic side view illustrating a portion of the illuminated keyboard according to the fourth embodiment of the present invention. In the illuminated keyboard 6, the transparent frame plate 61 is disposed on the supporting plate 60. The supporting plate 60 may increase the structural strength of the transparent frame plate 61, so that the possibility of bending the transparent frame plate 61 is minimized. The membrane switch circuit module 64 is disposed on the transparent frame plate 61. In the membrane switch circuit module 64, the upper wiring board 641 is laminated on the partition plate 642, and the partition plate 642 is laminated on the lower wiring board 643. The elastic film layer 65 is disposed on the membrane switch circuit module 64. The light source 63 is successively penetrated through the upper wiring board opening 6412, the second partition plate opening 6422, the lower wiring board opening 6432 and the frame plate opening 613, and inserted into the transparent frame plate 61. The elastic element 623 is disposed on the elastic film layer 65. The keycap 621 is disposed on the elastic element 623. When the keycap 621 is pressed and the elastic element 623 is compressed, the elastic element 623 is sustained against the membrane switch circuit module 64, which is disposed under the elastic element 623. In the membrane switch circuit module 64, the upper contact 6411 is inserted into the first partition plate opening 6421 to touch the lower contact 6431, so that electrical connection between the upper contact 6411 and the lower contact 6431 is established. Accordingly, a key signal corresponding to the pressed key 62 is generated. The scissors-type connecting member 622 is arranged between the transparent frame plate 61 and the keycap 621. The scissors-type connecting member 622 is used for connecting the transparent frame plate 61 and the keycap 621, and allowing the keycap 621 to be moved upwardly and downwardly with respect to the transparent frame plate 61. The relations between the first frame 6221 and the second frame 6222 of the scissors-type connecting member 622 and the transparent frame plate 61 and the keycap 621 and the operations of the pressed key 62 are similar to those of the first embodiment, and are not redundantly described herein.

After the light beam B' is emitted by the light source 63, the light beam B' is projected downwardly and directed to the transparent frame plate 61, and propagated within the transparent frame plate 61. Then, the light beam B' passing through the transparent frame plate 61 is reflected by the supporting plate 60, so that the propagating direction of the light beam B' is changed. Then, the light beam B' is directed to the membrane switch circuit module 64 through the transparent frame plate 61. After the light beam B' passes through the membrane switch circuit module 64, the light beam B' passes through the elastic film layer 65 and the elastic element 623, and is directed to the keycap 621. Then, the light beam B' passes through the light-transmissible region 6211 of the keycap 621, thereby illuminating the illuminated keyboard 6.

From the above discussions, the light beam B' emitted by the source 63, which is arranged between the transparent frame plate 61 and the membrane switch circuit module 64, is propagated along an optical path. Along the optical path, the light beam B' is projected downwardly and directed to the transparent frame plate 61, reflected by the supporting plate 60, and directed upwardly to the transparent frame plate 61, the membrane switch circuit module 64, the elastic film layer 65 and the light-transmissible region 6211 of the keycap 621.

It is noted that, however, those skilled in the art will readily observe that numerous modifications and alterations may be made while retaining the teachings of the invention. For example, like the second embodiment, an additional light-guiding film layer may be disposed between the supporting plate and the transparent frame plate. Alternatively, an additional light-guiding film layer may be arranged on the transparent frame plate.

From the above description, the transparent frame plate of the illuminated keyboard of the present invention has functions similar to the metallic base plate of the conventional illuminated keyboard, i.e. the function of connecting to the scissors-type connecting member. That is, through the scissors-type connecting member, the connection between the key and the transparent frame plate is similar to the connection between the key and the conventional metallic base plate. Moreover, since the transparent frame plate is made of a transparent material, the light source may be arranged at any position above or below the transparent frame plate, and the majority of the light beam may be transmitted through the transparent frame plate downwardly or upwardly without being sheltered by the conventional metallic base plate. In this situation, the brightness of the light beam passing through the keycap is enhanced. Moreover, since the majority of the light beam is not hindered by the conventional metallic base plate, the problem of non-uniformly illuminating the illuminated keyboard will be minimized. Since the transparent frame plate made of the transparent material is light-transmissible, the position of the light source is not restricted. That is, the light source may be arranged at any position between the key and the supporting plate.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An illuminated keyboard comprising:

a transparent frame plate;

a membrane switch circuit module disposed on said transparent frame plate, wherein said membrane switch circuit module comprises:

an upper wiring board having at least one upper contact and a light source circuit pattern, wherein a light source and said light source circuit pattern are disposed on said upper wiring board, and said light source circuit pattern is connected with said light source for driving said light source;

a partition plate disposed under said upper wiring board, and having a first partition plate opening and a second partition plate opening, wherein when said membrane switch circuit module is pressed, said upper contact is inserted into said first partition plate opening, wherein said light source is penetrated through said second partition plate opening; and lower wiring board disposed under said partition plate, and having a lower contact corresponding to said upper contact and a lower wiring board opening to be penetrated by said light source, wherein when said membrane switch circuit module is pressed, said upper contact is contacted with said lower contact, wherein said light source is successively penetrated through said second partition plate opening and said lower wiring board opening, and inserted into a frame plate opening of said transparent frame plate;

at least one key connected with said transparent frame plate, wherein when said key is pressed, said key is sustained against said membrane switch circuit module; and said light source is arranged between said key and said transparent frame plate for emitting a light beam.

2. An illuminated keyboard comprising:

a transparent frame plate;

a membrane switch circuit module disposed on said transparent frame plate, wherein said membrane switch circuit module comprises:

an upper wiring board having at least one upper contact;

a partition plate disposed under said upper wiring board, and having a partition plate opening and a light source circuit pattern, wherein when said membrane switch circuit module is pressed, said upper contact is inserted into said partition plate opening, wherein a light source and said light source circuit pattern are disposed on said partition plate, and said light source circuit pattern is connected with said light source for driving said light source; and a lower wiring board disposed under said partition plate, and having a lower contact corresponding to said upper contact and a lower wiring board opening to be penetrated by said light source, wherein when said membrane switch circuit module is pressed, said upper contact is contacted with said lower contact, wherein said light source is penetrated through said partition plate opening, and inserted into a frame plate opening of said transparent frame plate;

at least one key connected with said transparent frame plate, wherein when said key is pressed, said key is sustained against said membrane switch circuit module; and said light source is arranged between said key and said transparent frame plate for emitting a light beam.

3. An illuminated keyboard, comprising:

a transparent frame plate;

a membrane switch circuit module disposed on said transparent frame plate, wherein said membrane switch circuit module comprises:

an upper wiring board having at least one upper contact:

a partition plate disposed under said upper wiring board, and having a partition plate opening, wherein when said membrane switch circuit module is pressed, said upper contact is inserted into said partition plate opening; and a lower wiring board disposed under said partition plate, and having a lower contact corresponding to said upper contact and a light source circuit pattern, wherein when said membrane switch circuit module is pressed, said upper contact is contacted with said lower contact, wherein a light source and said light source circuit pattern are disposed on said lower wiring board, and said light source circuit pattern is connected with said light source for driving said light source, wherein said light source is inserted into a frame plate opening of said transparent frame plate;

at least one key connected with said transparent frame plate, wherein when said key is pressed, said key is sustained against said membrane switch circuit module; and said light source is arranged between said key and said transparent frame plate for emitting a light beam.

4. The illuminated keyboard according to claim 1 further comprising a supporting plate, which is disposed under said transparent frame plate for reflecting said light beam and avoiding bending said transparent frame plate.

5. The illuminated keyboard according to claim 4 further comprising a light-guiding film layer, which is arranged between said supporting plate and said transparent frame plate for guiding said light beam, wherein said light-guiding film layer has a light-guiding film opening to be penetrated by said light source, wherein said light beam successively passes through said transparent frame plate, said light-guiding film layer, said light-guiding film layer, said transparent frame plate, said membrane switch circuit module and said key.

6. The illuminated keyboard according to claim 1 wherein said key comprises:

a keycap exposed to a surface of said illuminated keyboard, and comprising a light-transmissible region;

a scissors-type connecting member arranged between said transparent frame plate and said keycap for connecting said transparent frame plate and said keycap, and allowing said keycap to be moved upwardly and downwardly with respect to said transparent frame plate; and an elastic element arranged between said membrane switch circuit module and said keycap, wherein when said keycap is pressed, said elastic element is compressed and sustained against said membrane switch circuit module, so that said upper contact is contacted with said lower contact, wherein when a pressing force exerted on said key is eliminated, an elastic force provided by said elastic element is acted on said keycap, so that said keycap is returned to an original position.

7. The illuminated keyboard according to claim 6 wherein said keycap comprises a first keycap fixing structure and a second keycap fixing structure, wherein said transparent frame plate comprises a first frame plate fixing structure and a second frame plate fixing structure, and said first frame plate fixing structure and said second frame plate fixing structure are integrally formed with said transparent frame plate, wherein said scissors-type connecting member comprises a first frame and a second frame, wherein a first end of said first frame is connected with said second frame plate fixing structure, a second end of said first frame is connected with said first keycap fixing structure, a first end of said second frame is connected with said second keycap fixing structure, and a second end of said second frame is connected with said first frame plate fixing structure.

8. An illuminated keyboard, comprising:

a supporting plate;

a transparent frame plate disposed on said supporting plate;

a membrane switch circuit module disposed on said transparent frame plate, wherein said membrane switch circuit module comprises:

an upper wiring board having at least one upper contact and an upper wiring board opening, wherein a light source is penetrated through said upper wiring board opening;

a partition plate disposed under said upper wiring board, and having a first partition plate opening and a second partition plate opening, wherein when said membrane switch circuit module is pressed, said upper contact is inserted into said first partition plate opening, wherein said light source is penetrated through said second partition plate opening; and a lower wiring board disposed under said partition plate, and having a lower contact corresponding to said upper contact and a lower wiring board opening to be penetrated by said light source, wherein when said membrane switch circuit module is pressed, said upper contact is contacted with said lower contact, wherein said light source is successively penetrated through said upper wiring board opening, said second partition plate opening and said lower wiring board opening, and inserted into said transparent frame plate;

at least one key connected with said transparent frame plate, wherein when said key is pressed, said key is sustained against said membrane switch circuit module;

a light source film layer arranged between said key and said membrane switch circuit module, and having a light source circuit pattern; and said light source is disposed on said light source film layer and connected with said light source circuit pattern, wherein said light source is driven by said light source circuit pattern to emit a light beam.

9. The illuminated keyboard according to claim 8 wherein said light source film layer is arranged between said membrane switch circuit module and said transparent frame plate, and said transparent frame plate has a frame plate opening to be inserted by said light source.

10. The illuminated keyboard according to claim 8 wherein said light source film layer is arranged between said transparent frame plate and said supporting plate, and said transparent frame plate has a frame plate opening to be inserted by said light source.

11. The illuminated keyboard according to claim 8 further comprising a light-guiding film layer, which is arranged beside said light source film layer for guiding said light beam, thereby changing a propagating direction of said light beam, wherein said light-guiding film layer has a light-guiding film opening to be penetrated by said light source.

12. The illuminated keyboard according to claim 8 wherein said key comprises:

a keycap exposed to a surface of said illuminated keyboard, and comprising a light-transmissible region;

a scissors-type connecting member arranged between said transparent frame plate and said keycap for connecting said transparent frame plate and said keycap, and allowing said keycap to be moved upwardly and downwardly with respect to said transparent frame plate; and an elastic element arranged between said membrane switch circuit module and said keycap, wherein when said keycap is pressed, said elastic element is compressed and sustained against said membrane switch circuit module, so that said upper contact is contacted with said lower contact, wherein when a pressing force exerted on said key is eliminated, an elastic force provided by said elastic element is acted on said keycap, so that said keycap is returned to an original position.

13. The illuminated keyboard according to claim 12 wherein said keycap comprises a first keycap fixing structure and a second keycap fixing structure, wherein said transparent frame plate comprises a first frame plate fixing structure and a second frame plate fixing structure, and said first frame plate fixing structure and said second frame plate fixing structure are integrally formed with said transparent frame plate, wherein said scissors-type connecting member comprises a first frame and a second frame, wherein a first end of said first frame is connected with said second frame plate fixing structure, a second end of said first frame is connected with said first keycap fixing structure, a first end of said second frame is connected with said second keycap fixing structure, and a second end of said second frame is connected with said first frame plate fixing structure.

14. An illuminated keyboard, comprising:

a transparent frame plate; a membrane switch circuit module disposed on said transparent frame plate, wherein said membrane switch circuit module comprises:

an upper wiring board having at least one upper contact and an upper wiring board opening, wherein a light source is penetrated through said upper wiring board opening;

a partition plate disposed under said upper wiring board, and having a first partition plate opening and a second partition plate opening, wherein when said membrane switch circuit module is pressed, said upper contact is inserted into said first partition plate opening, wherein said light source is penetrated through said second partition plate opening; and a lower wiring board disposed under said partition plate, and having a lower contact corresponding to said upper contact and a lower wiring board opening to be penetrated by said light source, wherein when said membrane switch circuit module is pressed, said upper contact is contacted with said lower contact, wherein said light source is successively penetrated through said upper wiring board opening, said second partition plate opening and said lower wiring board opening, and inserted into said transparent frame plate;

at least one key connected with said transparent frame plate, wherein when said key is pressed, said key is sustained against said membrane switch circuit module;

an elastic film layer arranged between said membrane switch circuit and said key, and having a light source circuit pattern; and said light source is disposed on said elastic film layer and connected with said light source circuit pattern, wherein said light source is driven by said light source circuit pattern to emit a light beam.

15. The illuminated keyboard according to claim 14 further comprising:

a supporting plate disposed under said transparent frame plate for reflecting said light beam and avoiding bending said transparent frame plate; and a light-guiding film layer arranged between said supporting plate and said transparent frame plate for guiding said light beam, thereby changing a propagating direction of said light beam.

16. The illuminated keyboard according to claim 14 wherein said elastic film layer has an elastic film opening, wherein when said key is pressed and moved downwardly with respect to said transparent frame plate, said key is partially penetrated through said elastic film opening, so that said elastic element is sustained against said membrane switch circuit module.

17. The illuminated keyboard according to claim 16 wherein said key comprises:

a keycap exposed to a surface of said illuminated keyboard, and comprising a light-transmissible region;

a scissors-type connecting member arranged between said transparent frame plate and said keycap for connecting said transparent frame plate and said keycap, and allowing said keycap to be moved upwardly and downwardly with respect to said transparent frame plate; and an elastic element disposed on said elastic film layer, wherein when said keycap is pressed, said elastic element is compressed and sustained against said elastic film layer, so that said upper contact is contacted with said lower contact, wherein when a pressing force exerted on said key is eliminated, an elastic force provided by said elastic element is acted on said keycap, so that said keycap is returned to an original position.

18. The illuminated keyboard according to claim 17 wherein said keycap comprises a first keycap fixing structure and a second keycap fixing structure, wherein said transparent frame plate comprises a first frame plate fixing structure and a second frame plate fixing structure, and said first frame plate fixing structure and said second frame plate fixing structure are integrally formed with said transparent frame plate, wherein said scissors-type connecting member comprises a first frame and a second frame, wherein a first end of said first frame is connected with said second frame plate fixing structure, a second end of said first frame is connected with said first keycap fixing structure, a first end of said second frame is connected with said second keycap fixing structure, and a second end of said second frame is connected with said first frame plate fixing structure.

* * * * *